US008502419B2

(12) United States Patent
Suardi et al.

(10) Patent No.: US 8,502,419 B2
(45) Date of Patent: Aug. 6, 2013

(54) MEDIUM VOLTAGE CIRCUIT BREAKER WITH CAPACITOR BANK SUPERVISOR

(75) Inventors: Gabriele Suardi, Endine Gaiano (IT); Massimo Bresciani, Villa di Serio (IT)

(73) Assignee: ABB Technology AG, Zurich (CH)

( * ) Notice: Subject to any disclaimer, the term of this patent is extended or adjusted under 35 U.S.C. 154(b) by 575 days.

(21) Appl. No.: 12/416,989

(22) Filed: Apr. 2, 2009

(65) Prior Publication Data

US 2009/0251011 A1 Oct. 8, 2009

(30) Foreign Application Priority Data

Apr. 4, 2008 (EP) ..... 08154119

(51) Int. Cl.

| | |
|---|---|
| ***H01H 3/26*** | (2006.01) |
| ***H01H 3/28*** | (2006.01) |
| ***H01H 33/36*** | (2006.01) |
| ***H01H 33/38*** | (2006.01) |
| ***H01H 47/00*** | (2006.01) |

(52) U.S. Cl.
USPC ..... 307/143; 324/548

(58) Field of Classification Search
USPC ..... 307/143
See application file for complete search history.

(56) References Cited

U.S. PATENT DOCUMENTS

| | | | | |
|---|---|---|---|---|
| 4,360,853 | A | 11/1982 | Welk | |
| 5,497,095 | A * | 3/1996 | Ueyama et al. | 324/537 |
| 6,356,086 | B1 * | 3/2002 | Cook et al. | 324/659 |
| 6,750,567 | B1 * | 6/2004 | Elli et al. | 307/143 |
| 7,173,438 | B2 * | 2/2007 | Pooranakaran et al. | 324/678 |
| 7,538,684 | B2 * | 5/2009 | Schnetker | 340/653 |

FOREIGN PATENT DOCUMENTS

| | | |
|---|---|---|
| EP | 1172833 | 1/2002 |
| JP | 09-229976 | * 5/1997 |
| JP | 2006059823 | 3/2006 |
| WO | 02/23572 | 3/2002 |
| WO | 2008/038421 | 4/2008 |

* cited by examiner

*Primary Examiner* — Rexford Barnie
*Assistant Examiner* — Toan Vu
(74) *Attorney, Agent, or Firm* — Michael M. Rickin

(57) ABSTRACT

A Medium Voltage Circuit Breaker that has at least a pair of contact mutually coupleable and uncoupleable to carry out an opening/closing operation, a magnetic actuator operatively connected to at least one of the contacts, and a capacitor bank that has one or more capacitors that deliver power to the magnetic actuator for carrying out the opening/closing operation and a control device. The Medium Voltage Circuit Breaker further has a supervisor device of the capacitor bank which measures the Equivalent Series Resistance and/or the Capacitance of the capacitor bank system.

15 Claims, 1 Drawing Sheet

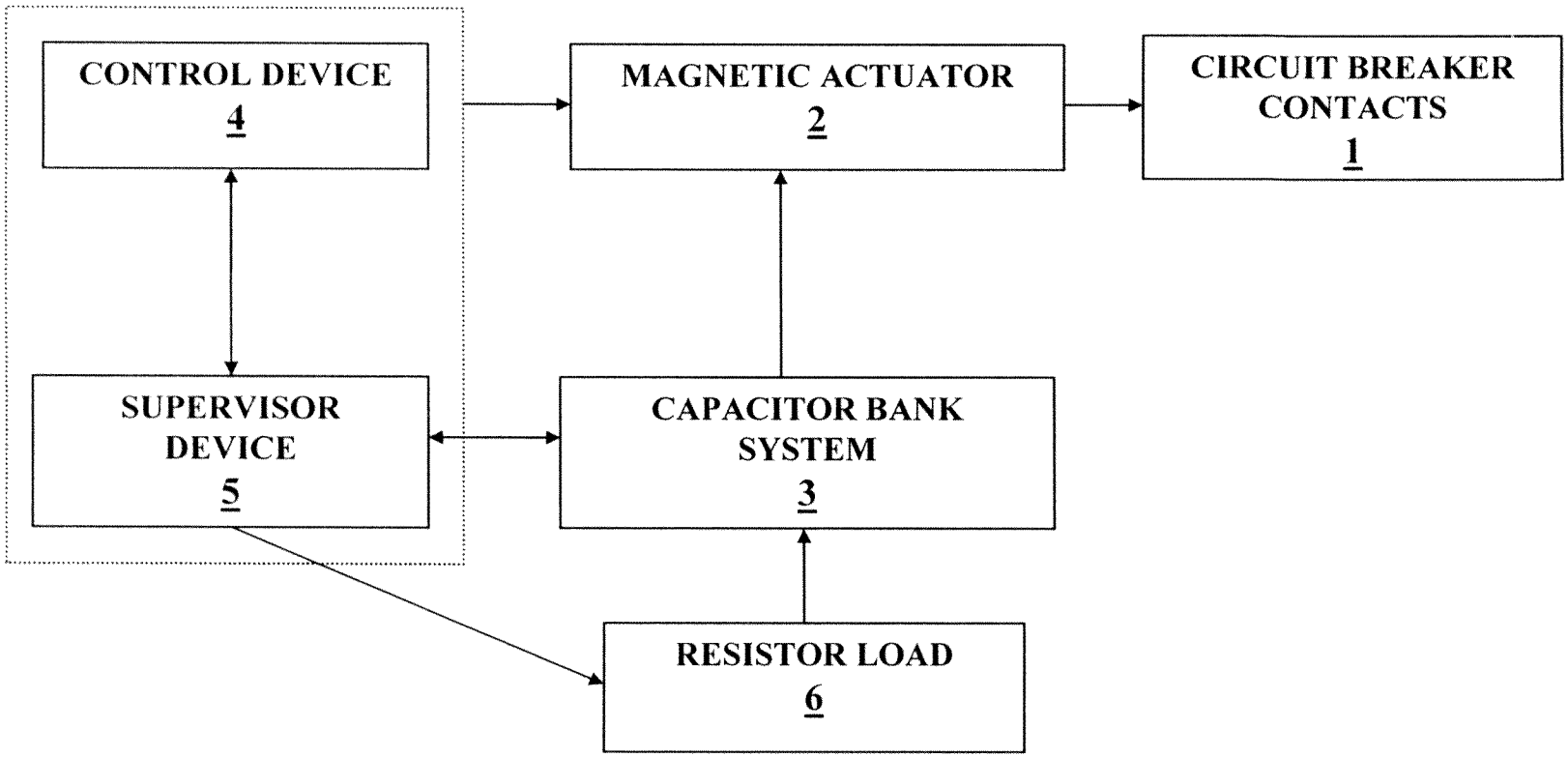
CIRCUIT BREAKER CONTACTS 1
MAGNETIC ACTUATOR 2
CAPACITOR BANK SYSTEM 3
RESISTOR LOAD 6
CONTROL DEVICE 4
SUPERVISOR DEVICE 5

MEDIUM VOLTAGE CIRCUIT BREAKER WITH CAPACITOR BANK SUPERVISOR

The present invention relates to a medium voltage circuit breaker operated by a magnetic actuator and having a capacitor bank supervisor unit. More in particular, the present invention relates to a medium voltage circuit breaker having a capacitor bank supervisor unit to detect a failure of one or more capacitors of a capacitor bank used to store the energy for actuating the magnetic actuator. For the purposes of the present application the term Medium Voltage is referred to applications in the range of between 1 and 52 kV, while the term circuit breaker generally refers to switching apparatuses such as circuit breakers, contactors and similar.

Medium voltage circuit breakers using a magnetig actuator for performing the opening and closing operations of the circuit breaker are well known in the art. In such systems the magnetic actuators are normally operatively connected to the movable contact(s) of the circuit breaker. The magnetic actuators are driven with the energy stored in a suitable energy storing system thereby imparting the desired motion (opening or closing) to the movable contact(s) of the circuit breaker.

Presently, one of the most widely systems used to store energy for these purposes is a capacitor bank, consisting of one or more capacitors connected in parallel. The capacitors work as energy accumulators and are able to supply high currents for a short period of time, typically less than 100 ms, i.e. the time-period needed for performing the relevant operation of the circuit breaker.

However, it is known that capacitors suffer a number of certain disadvantages, in particular the reduction or loss of capacitor characteristics mainly due to:

voltage polarity reversed;
overvoltage;
overheating;
ripple overcurrent;
vibrations, humidity and other minor overstress factors;
natural capacitor end-life.

Under normal condition of use the overheating, due to ambient conditions or to ripple overcurrent, is the first cause of life reduction of capacitors. As reported in applications notes of some manufacturers of capacitors, an increase of 12° C. of temperature above the rated temperature reduces the operative life of the capacitors by 50%.

When used as energy accumulators for magnetic-actuated circuit breaker, the reduction or loss of one or more characteristics of the capacitor can compromise the movement of the magnetic actuator, thereby leading to an incomplete or failed switching operation with potentially severe consequences on the system.

Currently, the control unit of capacitor banks used as energy accumulators in circuit breakers has a voltage monitoring system to monitor the charge of the capacitors. In reality, the control unit of known type only monitors the voltage of the capacitors and does not detect and indicate whether or not there is sufficient charge to operate the magnetic actuator. In other words, if the control unit sees a predetermined voltage (e.g. 80 Volts) on the output of the charge circuit, it is assumed that there is sufficient energy to operate. However, if the capacitor fails and is not able to provide the currents needed for the operation, the magnetic actuator will not be able to carry out the requested operation with potentially harmful consequences.

It is therefore an object of the present invention to provide a medium voltage circuit breaker in which the above-mentioned drawbacks are avoided or at least reduced.

More in particular, it is an object of the present invention to provide a medium voltage circuit breaker having a capacitor bank supervisor capable to detect the operability conditions of the capacitor bank.

As a further object, the present invention is aimed at providing provide a medium voltage circuit breaker having reduced risks of failure due to incorrect status of the capacitor bank.

SUMMARY OF THE INVENTION

A Medium Voltage Circuit Breaker (CB) has at least a pair of contacts mutually coupleable and uncoupleable to carry out an opening/closing operation, a magnetic actuator operatively connected to at least one of the contacts, a capacitor bank system having one or more capacitors that deliver power to the magnetic actuator for carrying out the opening/closing operation and a control device. The medium voltage CB further has a supervisor device of the capacitor bank. The supervisor device measures the Equivalent Series Resistance of the capacitor bank system. The measurement of the Equivalent Series Resistance is stopped when an opening or closing operation of the circuit breaker is launched.

A Medium Voltage Circuit Breaker (CB) comprising has at least a pair of contacts mutually coupleable and uncoupleable to carry out an opening/closing operation, a magnetic actuator operatively connected to at least one of the contacts, a capacitor bank system having one or more capacitors that deliver power to the magnetic actuator for carrying out the opening/closing operation and a control device. The medium voltage CB further has a supervisor device of the capacitor bank. The supervisor device measures the Capacitance of the capacitor bank system. The measurement of the Capacitance of the capacitor bank system is stopped when an opening or closing operation of the circuit breaker is launched.

DESCRIPTION OF THE DRAWING

FIG. 1 the only drawing figures shows a block diagram for the Medium Voltage CB.

DETAILED DESCRIPTION

Referring now to FIG. 1, which is the only drawing FIGURE, there is shown at least a pair of contacts 1 of a Medium Voltage circuit breaker (CB). The contacts 1 are mutually coupleable and uncoupleable to carry out the opening/closing operation of the Medium Voltage CB. A magnetic actuator 2 is operatively connected to at least one of the contacts 1 and is powered by a capacitor bank 3 comprising one or more capacitors that deliver power to the magnetic actuator 2 for carrying out the opening/closing operation. A control device 4 for managing the opening/closing operation and, in general, for controlling the whole circuit breaker is also present. The Medium Voltage CB further comprises a supervisor device 5 of the capacitor bank 3. The supervisor device 5 measures the Equivalent Series Resistance of the capacitor bank system 3.

Thus, differently from known systems where only the capacitor voltage was detected, the circuit breaker, as shown in FIG. 1, is equipped with a capacitor bank supervisor device 5 that detects the status of the operative life of the capacitor(s) 3 by measuring the Equivalent Series Resistance and/or the Capacitance of the capacitor bank system 3. The measured values of Equivalent Series Resistance and/or Capacitance are compared with the corresponding initial values (rated or predetermined through calibration) so as to check an Equivalent Series Resistance increase and/or a Capacitance reduction. Depending on the application and the characteristics of the capacitor bank 3, one or more threshold values (e.g. percentage of the initial Capacitance and/or Equivalent Series Resistance values measured during calibration) can be set thereby generating corresponding signaling errors when the measured values are outside the pre-set threshold(s).

Thus, the present invention relates to a Medium Voltage Circuit Breaker (CB) which comprises at least a pair of contact mutually coupleable and uncoupleable to carry out opening/closing operation; a magnetic actuator is operatively connected to at least one of said contacts and is powered by a capacitor bank comprising one or more capacitors that deliver power to said magnetic actuator for carrying out said opening/closing operation. A control device for managing the opening/closing operation and, in general, for controlling the whole circuit breaker is also present. The Medium Voltage CB according to the invention is characterized in that it comprises a supervisor device of said capacitor bank, said supervisor device measuring the Equivalent Series Resistance and/or the Capacitance of said capacitor bank system.

Thus, differently from known system where only the capacitor voltage was detected, the circuit breaker according to the invention is equipped with a capacitor bank supervisor device that detects the status of the operative life of the capacitor(s) by measuring the Equivalent Series Resistance and/or the Capacitance of said capacitor bank system. The measured values of Equivalent Series Resistance and/or Capacitance are compared with the corresponding initial values (rated or predetermined through calibration) so as to check an Equivalent Series Resistance increase and/or a Capacitance reduction. Depending on the application and the characteristics of the capacitor bank, one or more threshold values (e.g. percentage of the initial Capacitance and/or Equivalent Series Resistance values measured during calibration) can be set thereby generating corresponding signaling errors when the measured values are outside the pre-set threshold(s).

For the purposes of the present invention, the Equivalent Series Resistance is a single resistance representing all the losses of the capacitor, the connectors and the wiring connected in series with the capacitance.

In particular, the Medium Voltage CB according to the invention is equipped with a supervisor device of the capacitor bank in which the measurement of the Equivalent Series Resistance is based on the measure of the capacitor voltage before and after the application of a known resistor load 6.

In practice, the known resistor load 6 is inserted into the circuit and the Equivalent Series Resistance measurement is based on the following relation:

$$ESR=(V_capacitor_before—V_capacitor_after)/I_load,$$

where:

ESR is the Equivalent Series Resistance,

V_capacitor_before is the capacitor voltage before resistor load insertion,

V_capacitor_after is the capacitor voltage after resistor load insertion, and

I_load is the current flowing in the resistor load.

The detected ESR value is compared with an initial reference value of the Equivalent Series Resistance. In the event the comparison shows and increase of the Equivalent Series Resistance above a predetermined threshold a signaling error may be generated.

Preferably, the voltage measure after resistor load insertion should be performed very quickly to avoid the effect of capacitor discharge. In other words, as soon as the resistor load is inserted there is a voltage drop that is immediately detected so as to determine the Equivalent Series Resistance according to the above relation.

For what concerns the Capacitance measurement, this can be conveniently based on the measure of the time elapsed of capacitor voltage to fall down a fixed voltage drop after the application of a known resistor load.

In practice, once a resistor load is inserted into the circuit, the supervisor device of the capacitor bank measures the time needed to reach a predetermined voltage drop. Based on the following equation, the Capacitance value can be calculated:

$$C=Q/V$$

and, as derivation from the above relation, $$C=\Delta Q/\Delta V$$

and, with the insertion of the fundamental charge law $$C=I_load*\Delta t/\Delta V,$$

where:

C is the Capacitance value,

I_load is the current flowing in the resistor load,

ΔV is a fixed voltage drop, and

Δt is time elapsed of capacitor voltage to fall down the fixed voltage drop.

Also, from the above:

$$C*\Delta V=I_load*\Delta t$$

and, $$\Delta t=C*(\Delta V/I_load)$$

With a small voltage drop the load current may be considered constant. For instance, if 80 V is the rated capacitor voltage, a voltage drop (ΔV) of 0.5 V corresponds to the 0.625 of the nominal voltage, then the same variation results in the current measure. From the relations given above, if the voltage drop (ΔV) and the load current (I_load) are constant, then the capacitance measure is directly proportional to elapsed time. In general, the voltage drop (ΔV) should be minimized so as to avoid energy waste in the capacitor bank and preserve their capability to provide the magnetic actuator with enough energy to perform the whole cycle Opening/Closing/Opening (OCO operation).

Preferably the resistor load should be selected so as to minimize the measurement time for the Capacitance.

According to a preferred embodiment of the Medium Voltage CB according to the invention, the supervisor device comprises means to perform the calibration function and the measurement of the initial values of Equivalent Series Resistance and/or the Capacitance. In other words, when the supervisor device is installed a first measurement of the initial values Equivalent Series Resistance and/or the Capacitance is carried out in order to get the reference values to be used in the subsequent calculations of Equivalent Series Resistance and/or Capacitance.

Preferably, the calibration is not performed if at least one of the following conditions is detected: the measured ESR is higher than a predetermined value (e.g. 100 mΩ) and/or the measured Capacitance value is lower than a predetermined percentage (e.g. 25 or 30%) of a nominal value previously set.

In the Medium Voltage CB according to the present invention, the measurement of said Equivalent Series Resistance and/or the Capacitance can be automatically carried out with a pre-determined frequency and/or in correspondence of predetermined conditions. For instance the check of the capacitor bank and the calculation of Equivalent Series Resistance and/or the Capacitance can be carried repeatedly after a predetermined time (e.g. 24 hours) and/or when the capacitor voltage reaches a pre-determined value.

Preferably, the measurement of Equivalent Series Resistance and/or the Capacitance is stopped when an opening or closing operation of the circuit breaker is launched. In other words, measurement operations are interrupted when the control device recognizes that a circuit breaker operation is ongoing (i.e. when current is flowing in the magnetic actuator). In such a case, the data measured are not evaluated and the measurement operation automatically restart after the opening or closing operation of the circuit breaker is completed.

According to a preferred embodiment of the Medium Voltage CB according to the invention, the supervisor device comprises means for setting one or more threshold values of said Equivalent Series Resistance and/or the Capacitance. According to this embodiment, the supervisor device allows to manage at least one, but preferably two thresholds for the failure detection, based on the increase of the Equivalent Series Resistance and/or the decrease of the Capacitance. For instance a first threshold can be set in correspondence of a 50% increase of the Equivalent Series Resistance and/or a 25% decrease of the Capacitance, while a second threshold can be set in correspondence of a 100% increase of the Equivalent Series Resistance and/or a 25% decrease of the Capacitance.

The number and values of the threshold can of course be different, depending on the features of the capacitor(s) and depending on the intended application (e.g. circuit breaker, contactor, . . . .)

In a possible embodiment of a Medium Voltage CB according to the invention the supervisor device 5 is integrated in the control device 4. Preferably, according to an alternative embodiment, the supervisor device 5 is separated from the control device 4. According to this latter embodiment, existing circuit breakers can be upgraded by connecting the supervisor device 5 to the control device 4 of the circuit breaker and to the capacitor bank 3.

As it can be seen from the above description, the circuit breaker of the present invention has a number of advantages with respect to the circuit breaker operated by a magnetic actuator of conventional type.

In particular the operability and the status of the capacitor bank is kept under control in order to detect the reduction or loss of capacitor characteristics. In particular by measuring the Equivalent Series Resistance and/or the Capacitance it is possible to detect the status of the operative life of the capacitor(s), thereby avoiding or at least minimizing the risks of malfunctioning or misoperation of the circuit breaker.

The medium voltage circuit breaker and the electronic protection and control unit thus conceived may undergo numerous modifications and come in several variants, all coming within the scope of the inventive concept. Moreover, all the component parts described herein may be substituted by other, technically equivalent elements. In practice, the component materials and dimensions of the device may be of any nature, according to need and the state of the art.

The invention claimed is:

1. A Medium Voltage Circuit Breaker (CB) comprising at least a pair of contacts mutually coupleable and uncoupleable to carry out an opening/closing operation, a magnetic actuator operatively connected to at least one of said contacts, a capacitor bank system comprising one or more capacitors that deliver power to said magnetic actuator for carrying out said opening/closing operation and a control device, wherein said medium voltage CB further comprises a supervisor device of said capacitor bank, said supervisor device measuring the Equivalent Series Resistance of said capacitor bank system, and wherein said Equivalent Series Resistance measurement is stopped when an opening or closing operation of the circuit breaker is launched.

2. The Medium Voltage CB according to claim 1, wherein said Equivalent Series Resistance measurement is based on the following relation:

$$ESR=(V_capacitor_before-V_capacitor_after)/I_load,$$

where, ESR is the Equivalent Series Resistance, V_capacitor_before is the capacitor voltage before resistor load insertion, V_capacitor_after is the capacitor voltage after resistor load insertion, I_load is the current flowing in the resistor load.

3. The Medium Voltage CB according to claim 1, wherein said supervisor device comprises means to perform a calibration function and the measurement of the initial values of the Equivalent Series Resistance.

4. The Medium Voltage CB according to claim 1, wherein the measurement of said Equivalent Series Resistance is automatically carried out with a pre-determined frequency and/or in correspondence of pre-determined conditions.

5. The Medium Voltage CB according to claim 1, wherein said supervisor device comprises means for setting one or more threshold values of said Equivalent Series Resistance.

6. The Medium Voltage CB according to claim 1, wherein said supervisor device is integrated in said control device.

7. The Medium Voltage CB according to claim 1, wherein said supervisor device is separated from said control device.

8. A Medium Voltage Circuit Breaker (CB) comprising at least a pair of contacts mutually coupleable and uncoupleable to carry out an opening/closing operation, a magnetic actuator operatively connected to at least one of said contacts, a capacitor bank system comprising one or more capacitors that deliver power to said magnetic actuator for carrying out said opening/closing operation and a control device, wherein said medium voltage CB further comprises a supervisor device of said capacitor bank, said supervisor device measuring the Capacitance of said capacitor bank system, wherein said supervisor device measures the Capacitance of said capacitor bank system and said measurement of said Capacitance of said capacitor bank system is stopped when an opening or closing operation of said circuit breaker is launched.

9. The Medium Voltage CB according to claim 8, wherein said Capacitance measurement is based on the measure of the time elapsed of capacitor voltage to fall down a fixed voltage drop after the application of a known resistor load.

10. The Medium Voltage CB according to claim 8 wherein said Capacitance measurement is based on the following relation:

$$C=I_load*\Delta t/\Delta V,$$

where, C is the Capacitance value, I_load is the current flowing in the resistor load, ΔV is a fixed voltage drop, Δt is time elapsed of capacitor voltage to fall down the fixed voltage drop.

11. The Medium Voltage CB according to claim 9, wherein said known resistor load is selected so as to minimize the measurement time for the capacitance.

12. The Medium Voltage CB according to claim 8, wherein said supervisor device comprises means to perform a calibration function and the measurement of the initial values of the Capacitance of said capacitor bank system.

13. The Medium Voltage CB according to claim 8, wherein the measurement of the Capacitance of said capacitor bank system is automatically carried out with a pre-determined frequency and/or in correspondence of pre-determined conditions.

14. The Medium Voltage CB according to claim 8, wherein said supervisor device comprises means for setting one or more threshold values of the Capacitance of said capacitor bank system.

15. The Medium Voltage CB according to claim 1, wherein said Equivalent Series Resistance measurement is based on the measure of the capacitor voltage before the application of a known resistor load and the measure of the capacitor voltage immediately after the application of said known resistor load.

* * * * *